United States Patent [19]

Mares

[11] Patent Number: 4,662,793

[45] Date of Patent: May 5, 1987

[54] PILE TIP FOR PLURAL PILES

[75] Inventor: Bernard A. Mares, Scappoose, Oreg.

[73] Assignee: Versa Steel, Inc., Portland, Oreg.

[21] Appl. No.: 864,721

[22] Filed: May 19, 1986

[51] Int. Cl.[4] ..... E02D 7/14

[52] U.S. Cl. ..... 405/253; 405/255; 52/158

[58] Field of Search ..... 405/253, 254, 255, 250, 405/251; 52/155, 158, 159, 165

[56] References Cited

U.S. PATENT DOCUMENTS

| | | | |
|---|---|---|---|
| 834,866 | 10/1906 | Bern | 405/255 |
| 1,884,686 | 10/1932 | Hilpert . | |
| 3,123,978 | 3/1964 | Pruyn . | |
| 4,303,353 | 12/1981 | Dougherty . | |
| 4,585,678 | 7/1984 | Kunito | 405/267 |

FOREIGN PATENT DOCUMENTS

| | | | |
|---|---|---|---|
| 0189419 | 11/1983 | Japan | 405/253 |

*Primary Examiner*—Richard J. Scanlan, Jr.
*Assistant Examiner*—Kristina I. Hall
*Attorney, Agent, or Firm*—Klarquist, Sparkman, Campbell, Leigh & Whinston

[57] ABSTRACT

A pile tip is disclosed for use in driving interconnected piles into the ground. The pile tip includes a load bearing base which includes a ground engaging surface which engages and penetrates the ground as the piles are driven in tandem. Pile receiving sockets project from the base in a direction opposite to the ground engaging surface for receiving ends of the piles and for protecting the received ends as the piles are driven. The base also protects the joint or connector used to interconnect the piles.

18 Claims, 5 Drawing Figures

PILE TIP FOR PLURAL PILES

BACKGROUND OF THE INVENTION

This invention relates generally to pile driving and more particularly to pile tips or shoes for protecting the ends of piles as they are driven into the ground.

Structural support piles are commonly driven into the ground using powerful diesel hammers. It is important that the piles be driven into the ground in such a manner that the leading end of each pile does not deform as it penetrates the ground. If unprotected, the leading end of the pile can easily be deformed when it engages hard obstructions such as rock. This can reduce the load carrying capability of the pile and might cause the pile to fail.

Various types of protective attachments have been developed which are affixed to the driving ends of individual foundation piles. Examples of such attachments for H-beam piles are shown in U.S. Pat. Nos. 3,123,978 to Pruyn and 4,303,353 to Dougherty, Jr. Pile tip attachments for individual sheet piles are also known and available from Associated Pile & Fitting Corp. of Clifton, N.J.

In many instances, it is desirable to connect a pair of piles along their length, and drive the piles in tandem into the ground. A joint or connector secures the piles together. One such connector is shown in U.S. Pat. No. 1,884,686 to Hilpert.

When piles are driven in pairs, the end of one pile can encounter a rock or obstruction while the other pile bypasses or clears the obstruction. If the rock is large enough and hard enough, the end of the sheet pile hitting the rock can deform. Additionally, the uneven forces exerted on the two piles can be great enough to cause separation of the piles along the joint. Also, the end of the joint itself is exposed where it can catch on rocks and deform or fail. These problems have not been solved by protecting individual piles of the pair with Pruyn or other known tips.

SUMMARY OF THE INVENTION

Accordingly, it is an object of the present invention to provide a pile tip for use in protecting the ends of simultaneously driven first and second interconnected piles.

Yet another object of the present invention is to provide a pile tip which protects a joint or connector, used to interconnect the piles, as the piles are driven into the ground.

The invention comprises a pile tip having a load bearing base which includes a ground engaging surface which penetrates the ground as the piles are driven in tandem. Pile receiving sockets project from the base in a direction opposite to the ground engaging surface for receiving the ends of the piles and for protecting the received ends of the piles as the piles are driven. The base also protects the joint or connector used to interconnect the piles.

These and other objects, features, and advantages of the present invention will be more readily understood from the following detailed description of preferred embodiments which proceed with reference to the accompanying drawings.

DETAILED DESCRIPTION OF PREFERRED EMBODIMENTS

Figure 1:
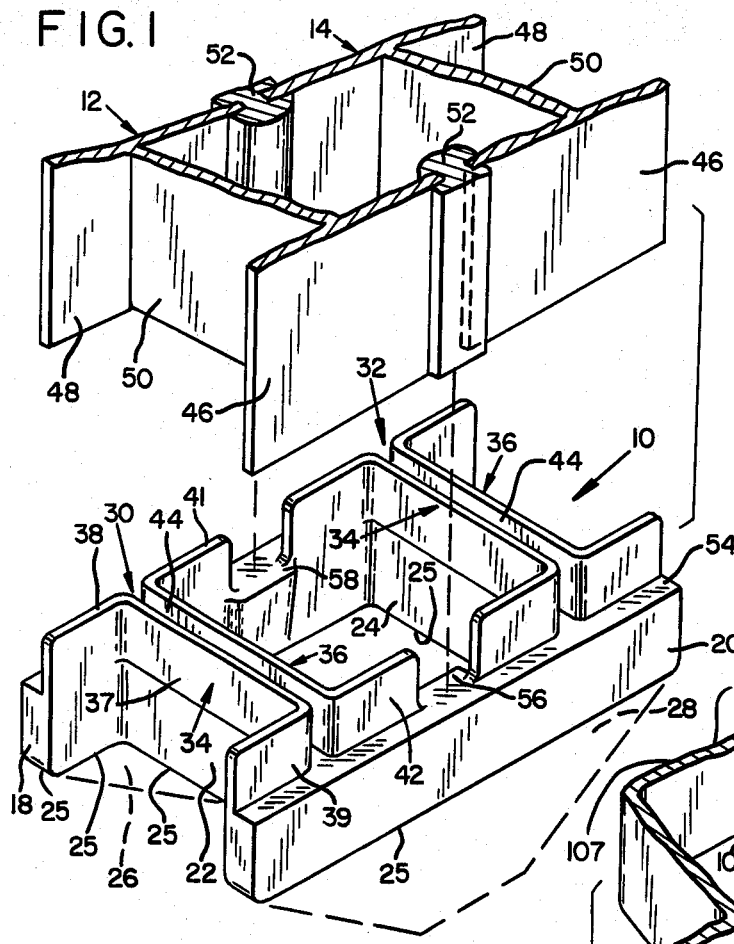
FIG. 1 is a perspective view of one embodiment of a pile tip of the invention for protecting interconnected H-piles and which shows an alternate embodiment in dashed lines.
Figure 2:
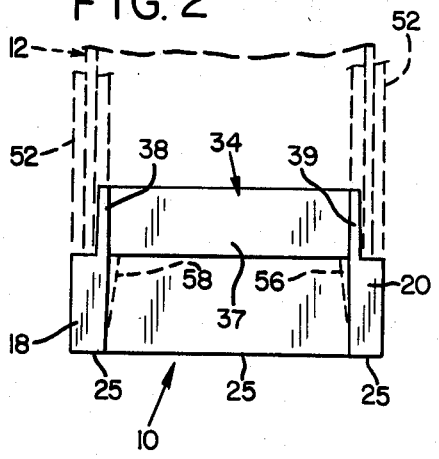
FIG. 2 is a side elevational view of the pile tip of FIG. 1.
Figure 3:
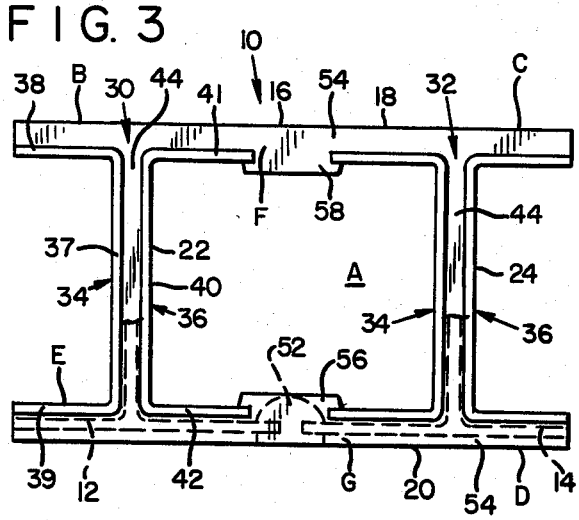
FIG. 3 is a top plan view of the pile tip of FIG. 1.

Referring to FIGS. 1–3, a first form of a pile tip 10 is shown for protecting the ends of interconnected H-piles 12, 14 as these piles are driven into the ground. The pile tip 10 includes a load bearing base 16. The base 16 is comprised of first and second spaced apart parallel rails 18, 20 interconnected by first and second parallel spaced apart cross pieces 22, 24 extending transversely therebetween. Base 16 is typically made of a durable extremely hard material such as hardened steel. Base 16 also includes a ground engaging surface 35 which engages and penetrates the ground as the interconnected piles are driven. In the FIG. 1 form of the invention, the side rails and cross pieces are generally rectangular. Also, the ground engaging surface is flat and comprises the lower edges of the respective side rails 18, 20 and cross pieces 22, 24. In an alternate form of the invention, shown in dashed lines in FIG. 1, side rails 18 and 20 are tapered to provide generally trapezoidal rail extensions 26, 28 which facilitate penetration of certain types of ground. Alternately, the extension 26, 28 may be triangular and terminate in a point to provide a sharp driving or ground cutting edge.

As is best illustrated in FIG. 3, base 16 can also be viewed as comprised of a central section in the form of a closed geometric shape, such as a rectangle A. Four segments B, C, D, and E extend outwardly from respective corners of the rectangle. Segments B and C are aligned with a first side F of the central section. The other two segments D and E are aligned with a second side G of the central section.

Referring to FIGS. 1–3, base 16 includes first and second pile receiving sockets 30, 32 which project in a direction opposite to the ground engaging surface 25. Each pile receiving socket 30, 32 is comprised of first and second U-shaped flanges 34, 36. Flange 34 has a central section 37 and first and second parallel legs 38, 39 projecting from ends of the central section. Flange 36 also has a central section 40 and a pair of similar legs 41, 42. The central sections 37, 40 of the flanges 34, 36 are spaced apart so as to define a pile web receiving slot 44 therebetween. Also, the first legs 38, 41 of the first and second flanges project from the first side rail 18 while the second legs 39, 42 of the first and second flanges project from the second side rail 20. The slots 44 defined by the respective sockets are positioned across the cross pieces 22, 24.

The pile receiving sockets 30, 32 are adapted to receive the ends of the first and second H-piles 12, 14. Each pile has a pair of parallel flanges 46, 48 joined by a perpendicular web 50. Adjacent longitudinal edges of the flanges 46 and 48 are interconnected by a joint or connector, such as 52, extending along the length of the piles. The slots 44 of the first and second pile receiving sockets 30, 32 are positioned to receive webs 50 of the respective first and second piles 12, 14. When received in this manner, the received ends of piles 12, 14 bear against an upper surface 54 of base 16. Pile tip 10 is securely affixed to the ends of piles 12, 14, as by welding, prior to driving the tip and piles into the ground.

The FIG. 1 form of base 16 also includes pile joint shielding means disposed between the first and second sockets 30, 32. This shielding means is aligned with the joints interconnecting the H-piles for protecting the joints as the piles are driven into the ground. In the form shown, the joint shielding means comprises a pair of projections or bulges 56, 58 in side rails 16, 18. These bulges are positioned to shield connectors 52 from rock and other obstructions as the piles are driven. The bulges 56, 58 project inwardly toward one another from rails 20, 18, respectively, and are tapered to facilitate driving. That is, bulges 56, 58 are wedge shaped and narrowest adjacent to the ground engaging surface 25 and widest adjacent to surface 54 of the base. The bulges 56, 58 are shown in dashed lines in FIG. 2 to indicate that they are optional. Even when omitted, the base rails 18, 20 provide substantial shielding of the pile joints. Also, a gap or space is provided between flanges 41, 42 of socket 30 and the adjacent flanges of socket 32. This gap provides clearance for connectors 52 so that, when tip 10 is in place, the connectors abut and are protected by surface 54 of the base.

Figure 4:
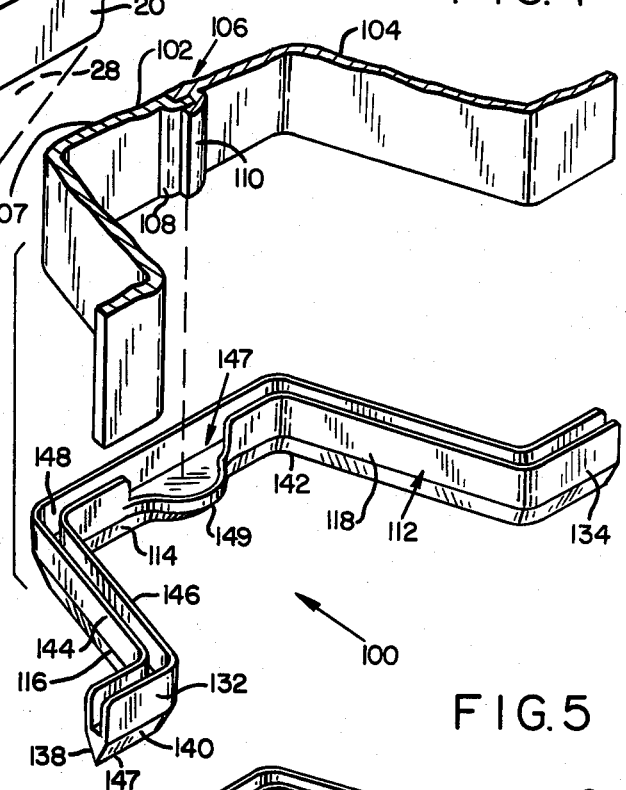
FIG. 4 is a perspective view of another embodiment of a pile tip in accordance with the invention for protecting interconnected sheet piles.

A second embodiment of the invention is shown in FIG. 4. Referring to FIG. 4, a pile tip 100 is shown configured to receive first and second sheet piles 102, 104 which are interconnected along a joint 106. Joint 106 is formed by interconnecting male and female connector portions 108, 110 formed along the adjacent longitudinal edges of flanges of the sheet piles 102, 104. Typically, when connected in this manner, the outer surface 107 of the joined piles is planar. In addition, connectors 108, 110 project somewhat from the plane of the joined flanges. The sheet piles, when so connected, are in a flared channel-like shape.

Sheet pile tip 100, like the tip 10 of FIG. 1, also includes a base 112. This base 112 is in a flared channel-like configuration which conforms to that of the interconnected sheet piles. Base 112 includes a central section 114 and first and second legs 116, 118 which project outwardly from the ends of the central section. The first and second legs diverge from one another moving in a direction away from central section 114. The distal ends of the first and second legs terminate in out turned feet 132, 134. Feet 132, 134 extend in opposite directions from one another and are generally parallel to central section 114. The base 112 has a ground engaging surface which engages and penetrates the ground as the piles are driven. This ground engaging surface is tapered and comprised of surfaces 138, 140 which terminate in a ground cutting edge 142.

Tip 100 also includes first and second spaced apart generally parallel socket defining flanges 144, 146 which, in the FIG. 4 orientation, project upwardly from base 112. Socket flanges 144, 146 define a channel 148 therebetween for receiving the ends of the interconnected sheet piles 102, 104. When inserted in this manner, the base protects the received ends of the first and second piles as the piles are driven in tandem into the ground.

With further reference to FIG. 4, the flange 146 bounds the interior of the pile tip channel and includes a gap 147. This gap is positioned to be aligned with joint 106. Thus, in the illustrated form of pile tip, gap 147 is centered along the central section 114 of the tip. The gap 147 is sized and positioned to provide clearance for joint 106 when the piles 102, 104 are inserted into the pile receiving channel 148.

Central section 114 may also include joint shielding means for shielding joint 106 at the received end of the piles as the sheet piles are driven. The shield means may comprise bulge 149 projecting from the central section 114 and aligned with gap 147. When so positioned, bulge 149 shields the joint 106 as the piles 102, 104 are driven. The illustrated projection 149 is generally hemispherical in shape and tapers moving from the base of channel 148 toward edge 142. This facilitates driving of the pile tip.

Figure 5:
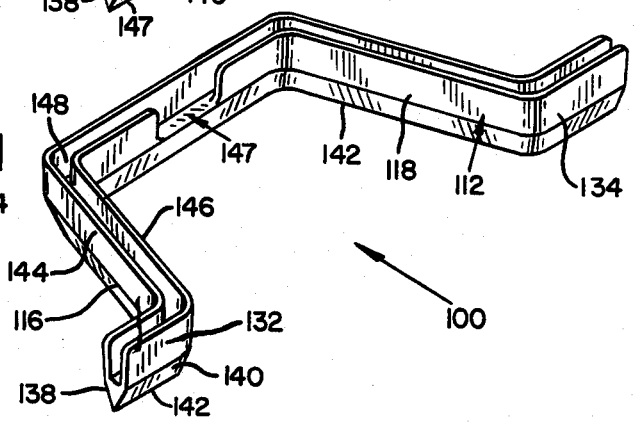
FIG. 5 is a perspective view of a further embodiment of a pile tip of the invention for protecting interconnected sheet piles.

FIG. 5 illustrates a modification of the FIG. 4 embodiment in which the optional projection or bulge 149 is eliminated. For convenience, elements of the FIG. 5 pile tip are numbered with the same number as the corresponding elements of the FIG. 4 pile tip. Although not providing the protection of the FIG. 4 embodiment, the FIG. 5 form of the invention is suitable in many applications.

In use, a pile tip of appropriate shape, and in accordance with the invention, is first welded or otherwise affixed to a pair of interconnected piles. When so mounted, the pile tip forms a generally continuous driving surface which protects the piles and minimizes the possibility of the piles becoming separated as they are driven. For example, if one pile of a pair hits an obstruction not encountered by the other pile of the pair, the one pile will not be dislodged from the other.

Having illustrated and described the principles of my invention with reference to several preferred embodiments, it should be apparent to those persons skilled in the art that such invention may be modified in arrangement and detail without departing from such principles. I claim as my invention all such modifications as come within the true spirit and scope of the following claims.

I claim:

1. A pile tip for use in simultaneously driving first and second piles into the ground, the piles being interconnected along their length, comprising:

a load bearing base having a ground engaging surface which engages and penetrates the ground as the piles are driven; and first and second pile receiving sockets projecting from the base in a direction opposite to the ground engaging surface, the first pile receiving socket comprising means for receiving an end of the first pile and the second pile receiving socket comprising means for receiving an end of the second pile, whereby the base protects the received ends of the first and second piles when the piles are driven in tandem into the ground.

2. The pile tip of claim 1 wherein the base comprises first and second spaced apart side rails with first and second spaced apart cross pieces extending therebetween.

3. The pile tip of claim 2 for use in simultaneously driving first and second H piles into the ground, wherein each pile receiving socket comprises first and second U-shaped flanges each having a central section and first and second legs, the central section of the first flange and the central section of the second flange projecting from a respective one of the cross pieces and being spaced apart so as to define a pile web receiving slot therebetween, the first legs of the first and second flanges projecting from the first of the side rails and the second legs of the first and second flanges projecting from the second of the side rails.

4. The pile tip of claim 1 wherein the base is in a flared channel-like configuration and comprises a central section with first and second ends, a first leg having a first end connected to the first end of the central section, a second leg having a first end connected to the second end of the central section, the first and second legs diverging from one another in a direction away from the central section, and the first and second legs terminating in respective foot portions which project in opposite directions from one another and which are parallel to the central section.

5. The pile tip of claim 1 wherein the first and second piles are interconnected by at least one joint along the length of the piles and wherein the base includes joint shielding means disposed between the first and second sockets and aligned with one joint for shielding the joint from the ground as the piles are driven into the ground.

6. The pile tip of claim 5 wherein the joint shielding means comprises a projecting bulge in the load bearing base which shields the joint.

7. The pile tip of claim 6 wherein the projecting bulge is tapered and is narrowest at a location nearest to the ground engaging surface and is widest at a location further from the ground engaging surface.

8. The pile tip of claim 2 wherein each of the two first and second spaced apart side rails terminates in a flat surface which comprises the ground engaging surface.

9. The pile tip of claim 2 wherein each of the first and second side rails are of a trapezoidal shape.

10. The pile tip of claim 2 wherein each of the first and second side rails has a ground engaging surface which tapers to a ground cutting edge.

11. A pile tip for use in simultaneously driving first and second piles into the ground, the piles being interconnected along their length, comprising:

a load bearing base having a ground engaging surface which engages and penetrates the ground as the piles are driven, the base including a central section in the form of a closed geometric shape and including at least four projecting segments extending outwardly from the central section;

first and second pile receiving sockets projecting from the base in a direction opposite to the ground engaging surface, the first pile receiving socket comprising means for receiving an end of the first pile and the second pile receiving socket comprising means for receiving an end of the second pile, whereby the base protects the received ends of the first and second piles when the piles are driven in tandem into the ground.

12. The pile tip of claim 11 wherein the central section includes four sides in the form of a rectangle and each of the segments extends outwardly from respective corners of the rectangle, two of the segments being aligned with a first side of the central section and two of the segments being aligned with a second side of the central section, the second side being parallel to the first side.

13. A pile tip for use in simultaneously driving first and second sheet piles into the ground, the piles being interconnected along their length, comprising:

an elongated load bearing base having a ground engaging surface which engages and penetrates the ground as the piles are driven, the base having a flared channel-like configuration and comprising a central section, first and second legs projecting from the central section and diverging from one another, the first and second legs terminating in respective foot sections which extend in opposite directions from one another; and first and second spaced apart socket defining flanges which project from the base in a direction opposite to the ground engaging surface, the socket defining flanges defining a channel therebetween for receiving an end of the first and second piles, whereby the base protects the received ends of the first and second piles when the piles are driven in tandem into the ground.

14. The pile tip of claim 13 wherein the first and second piles are interconnected by at least one joint along the length of the piles and wherein the central section includes joint shielding means for shielding the joint at the received end of the piles from the ground as the sheet piles are driven.

15. The pile tip of claim 13 wherein the first and second piles are interconnected by at least one joint along the length of the piles, the channel-like base includes an interior side edge bounding the interior of the channel configuration and an exterior side edge bounding the exterior of the channel configuration;

the first flange bounding the interior of the channel configuration and having a gap which is aligned with the joint, the gap being sized and positioned to receive the joint when the first and second piles are inserted into the pile receiving channel.

16. The pile tip of claim 14 wherein the joint shielding means comprises a projecting bulge in the load bearing base which is positioned to shield the joint of the received ends of the sheet piles as the sheet piles are driven.

17. The pile tip of claim 16 wherein the bulge tapers in a direction from the socket defining flanges toward the ground engaging surface.

18. The pile tip of claim 16 wherein the bulge is generally hemispherical in shape having a rounded outer surface.

* * * * *